US007024828B2

(12) United States Patent
Headrick

(10) Patent No.: US 7,024,828 B2
(45) Date of Patent: Apr. 11, 2006

(54) ROLLABLE BAFFLED RIDGE VENT

(75) Inventor: J. Charles Headrick, Alpharetta, GA (US)

(73) Assignee: Building Materials Investment Corporation, Wilmington, DE (US)

( * ) Notice: Subject to any disclaimer, the term of this patent is extended or adjusted under 35 U.S.C. 154(b) by 0 days.

(21) Appl. No.: 10/293,376

(22) Filed: Nov. 12, 2002

(65) Prior Publication Data

US 2004/0088932 A1 May 13, 2004

(51) Int. Cl.
*E04H 12/28* (2006.01)

(52) U.S. Cl. ..... 52/198; 52/95; 52/199; 464/435

(58) Field of Classification Search ..... 52/51, 52/198, 199, 302.3, 302.6; 454/364, 365, 454/366, 367
See application file for complete search history.

(56) References Cited

U.S. PATENT DOCUMENTS

| | | | | |
|---|---|---|---|---|
| 3,185,070 | A | 5/1965 | Smith | 98/42 |
| 3,236,170 | A | 2/1966 | Meyer et al. | 98/42 |
| 3,660,955 | A | 5/1972 | Simon | 52/420 |
| 3,949,657 | A | 4/1976 | Sells | 98/42 A |
| 4,280,399 | A | 7/1981 | Cunning | 98/42 A |
| 4,676,147 | A | 6/1987 | Mankowski | 98/42.21 |
| 4,817,506 | A | 4/1989 | Cashman | 98/42.21 |
| 4,843,953 | A | 7/1989 | Sells | 98/42.21 |
| 4,899,505 | A | 2/1990 | Williamson et al. | 52/199 |
| 4,903,445 | A | 2/1990 | Mankowski | 52/199 |
| 4,924,761 | A | 5/1990 | MacLeod et al. | 98/42.21 |
| 4,957,037 | A | 9/1990 | Tubbesing et al. | 98/42.21 |
| 5,009,149 | A | 4/1991 | MacLeod et al. | 98/42.21 |
| 5,052,286 | A | 10/1991 | Tubbesing et al. | 98/42.21 |
| 5,054,254 | A | 10/1991 | Sells | 52/199 |
| 5,060,431 | A | 10/1991 | MacLeod et al. | 52/199 |
| 5,070,771 | A | 12/1991 | Mankowski | 454/275 |
| 5,092,225 | A | 3/1992 | Sells | 454/365 |
| 5,095,810 | A * | 3/1992 | Robinson | 454/365 |
| 5,112,278 | A | 5/1992 | Roberts | 98/365 |
| 5,122,095 | A | 6/1992 | Wolfert | 454/365 |
| 5,149,301 | A | 9/1992 | Gates | 454/365 |
| 5,167,579 | A | 12/1992 | Rotter | 454/365 |
| 5,304,095 | A | 4/1994 | Morris | 454/365 |
| 5,425,672 | A | 6/1995 | Rotter | 454/365 |
| 5,457,920 | A * | 10/1995 | Waltz | 52/199 |
| 5,458,538 | A | 10/1995 | MacLeod et al. | 454/365 |
| 5,600,928 | A | 2/1997 | Hess et al. | 52/309.4 |

(Continued)

*Primary Examiner*—Ramon O. Ramirez
*Assistant Examiner*—Steven Marsh
(74) *Attorney, Agent, or Firm*—Womble Carlyle Sandridge & Rice, PLLC

(57) ABSTRACT

A rollable baffled ridge vent has a top panel with a laterally flexible central portion and edges. Substantially flat wind baffles are supported outboard of the edges and each wind baffle is formed by an array of aligned coextensive rectangular baffle sections. Each baffle section is supported by a pair of buttresses that project from beneath the top panel. Some of the buttresses also extend inwardly toward the central portion of the panel to form supports for supporting the ridge vent on a roof. The ridge vent can be fabricated in roof length sections that can be rolled into rolls with the baffle sections splaying with respect to each other to provide rollability. For installation, the ridge vent is rolled out along the open ridge of a roof and attached with nails. Superior ventilation is provided by the high net free area and flat wind baffle design of the vent while preserving the convenience of a rollable product.

20 Claims, 5 Drawing Sheets

U.S. PATENT DOCUMENTS 5,603,657 A * 2/1997 Sells ..... 454/359
5,772,502 A * 6/1998 Smith ..... 454/365
6,128,869 A * 10/2000 Brotherton et al. ..... 52/198
6,227,963 B1 * 5/2001 Headrick ..... 454/365
6,233,887 B1 * 5/2001 Smith ..... 52/199
6,260,315 B1 * 7/2001 Smith ..... 52/199
6,371,847 B1 * 4/2002 Headrick ..... 454/365
6,450,882 B1 * 9/2002 Morris et al. ..... 454/365

* cited by examiner

ROLLABLE BAFFLED RIDGE VENT

TECHNICAL FIELD

This invention relates generally to attic ventilation and more specifically to "shingle-over" ridge vents installable along an open ridge of a roof to provide ventilation.

BACKGROUND

It is important when constructing modern homes and other buildings that the attic space of the building be adequately ventilated. The failure to provide adequate ventilation can result in a variety of serious problems including, for example, the growth of mold in and around the attic space. A variety of attic ventilation techniques and products have been used over the years to provide attic ventilation. These include open-eve vents, attic fans, and convection vents spaced along a roof near its ridge. More recently, so called "shingle-over ridge vents" have become increasingly ubiquitous in homes and commercial buildings. A shingle-over ridge vent is a long usually plastic panel that generally is installed along the ridge of a roof covering an open slot formed therealong. The ridge vent is formed with air passageways and openings that allow hot air within the attic to escape through the ridge slot while the ridge vent covers the open slot preventing rain and debris from entering the attic. Once installed, the ridge vent is covered over with shingles to provide an aesthetically pleasing substantially normal appearance along the roof ridge.

Ridge vents generally are available in two fundamental configurations; namely, relatively short panel-type ridge vents, which are individually positioned and installed end-to-end along a roof ridge, and so-called "rolled" ridge vents, which are long continuous vents that are provided in rolls and are un-rolled along a roof ridge and attached with nails or staples. Each has its advantages and shortcomings. For instance, panel ridge vents can be designed with more elaborate features such as wind baffles outboard of the vent openings that improve air flow by generating low pressure regions just inboard of the wind baffles in the regions of the vent openings. For this and other reasons, panel-type ridge vents in general are highly efficient at providing attic ventilation. However, they are difficult and time consuming to install because each panel must be installed separately in end-to-end relationship with adjacent panels.

Rolled ridge vents, on the other hand, are simple to install relative to panel-type ridge vents because a roofer need only roll the vent out along the ridge, cut it to length, and attach it to the roof. However, since rolled ridge vents must be flexible in order to be rolled, they typically are much less sophisticated in design and configuration that panel-type ridge vents and sometimes are nothing more that long bats of loosely woven fibrous plastic material that presumably allow air flow to flow through their open weave structure. Traditionally, rolled ridge vents have not included the complex air channels, vents, and wind baffles of panel-type ridge vents. As a result, rolled ridge vents, although easy to install, have been shown to be exceedingly inefficient at providing attic ventilation and some are not much better than having no vent at all.

At least one attempt has been made to develop a ridge ventilation system that is rollable into compact rolls for convenient storage and installation yet that includes some of the sophisticated design features and provides the efficient air flow characteristics of panel-type ridge vents. U.S. Pat. No. 6,260,315 discloses such a rollable ridge vent. In this design, a plastic central panel is formed with wind baffles outboard of the panel's edges. The wind baffles are corrugated or, according to the patent, "undulating," to allow the panel to be rolled-up into a compact roll similar to open weave mat-type rolled ridge vents. When rolled, the corrugated wind baffles flex in an accordion-like manner to allow for the rolling of the vent. The panel also is formed with a somewhat elaborate array of supports on its underside to maintain spacing between the roof decking and the panel such that air flow allegedly is not restricted. While the design of this ridge vent may be a step in the right direction, it nevertheless has its own set of problems and shortcomings. For example, the corrugated or "undulating" configuration of the wind baffles increases substantially the amount of plastic required to mold the panel and thus increases the cost of the product. This is also true for the elaborate support structures on the underside of the panel. More importantly, the support structures and vent design of this product decreases its net-free-area (NFA) and therefore decreases its ventilation efficiency. It also is believed that the corrugated or undulating shape of the side baffles disrupts the laminar flow of wind across the vent, thereby destroying or degrading the low pressure region just inboard of the wind baffles (sometimes referred to as the "venturi effect") that accounts for increased efficiency of panel-type ridge vents. Accordingly, although the product disclosed in the '315 patent purportedly is rollable, it still fails to provide the corresponding high efficiency ventilation of well designed panel-type ridge vent systems.

Accordingly, a need persists for a ridge vent that provides the ease of installation of a traditional rolled ridge vent product and also the highly efficient air-flow and ventilation characteristics of a panel-type ridge vent system. Such a ridge vent should have a high net free area for unhampered flow of air from the attic space, should require a minimum volume of plastic for its fabrication, and should verifiably exhibit ventilation characteristics comparable to those of panel-type ridge vents. It is to the provision of such a ridge ventilation system that the present invention is primarily directed.

SUMMARY OF THE INVENTION

Briefly described, the present invention, in a preferred embodiment thereof, comprises a rollable baffled ridge vent system that provides both convenience of installation and highly efficient ventilation. The ridge vent system includes an elongated plastic ridge vent that is supplied in rolls and that is unrolled and attached along the ridge of a roof in a manner similar to traditional open weave mat-type ridge vents. However, the vent of this invention has a configuration similar to panel-type ridge vents. More specifically, the vent, which preferably is formed of injection molded plastic, has a top panel with a flexible central portion and edges. A flat upstanding wind baffle is positioned along and outboard of the edges of the panel. A series of narrow louvers or ribs extend from the edge of the panel downwardly to the bottom portion of the wind baffle. The spaces between the louvers together form an opening though which attic air can escape laterally from beneath the panel.

In order to provide for rollability of the vent, the flat upstanding outboard wind baffle is defined by a series of relatively short baffle sections that each is supported by a pair of buttresses extending laterally from beneath the panel. The buttresses project a significant distance inwardly toward the center portion of the panel such that, in addition to supporting the baffle sections, they also form a series of laterally extending supports on the underside of the panel. These supports rest on the roof and maintain spacing between the roof shingles and the underside of the panel to provide a plenum through which air flows laterally out the side vents. Since the supports are relatively thin and extend in a lateral direction relative to the panel, they do not significantly reduce the NFA of the vent and thus do not degrade the air flow through the vent.

The sectioned flat baffle sections are aligned and coextensive and together form a substantially continuous outboard flat wind baffle similar to those of panel-type ridge vents. This configuration preserves the laminar flow of wind across the vent and the resulting low pressure in the region of the louvered opening that enhances air flow. However, when the vent is rolled up along its length, the adjacent baffle sections splay with respect to each other. This allows long sections of vent to be delivered in rolls and rolled out along a roof ridge for installation similar to traditional open weave mat-type vents. The spacing between the ribs of the louvered vent, the space between the edges of the panel and the baffle, and the thickness of the laterally extending supports are selected to provide the maximum possible NFA. All of these features provide ventilating performance similar to that of traditional panel-type ridge vents. Further, the flat design of the baffles and the simple lateral supports/baffle buttresses require a minimum of plastic material during fabrication.

Accordingly, a rollable baffled ridge vent is now provided that addresses successfully the problems and shortcomings of the prior art. Long sections of the vent may be rolled-up into convenient rolls and installed quickly and easily just like mat-type ridge vents. Nevertheless, the vent of this invention provides superior ventilation similar to traditional panel-type ridge vents. It exhibits maximum NFA for superior air flow and requires a minimum of plastic for its construction. These and other features, objects, and advantages of the present invention will become more apparent upon review of the detailed description set forth below when taken in conjunction with the accompanying drawing figures, which are briefly described as follows.

DETAILED DESCRIPTION OF THE PREFERRED EMBODIMENTS

Figure 1:
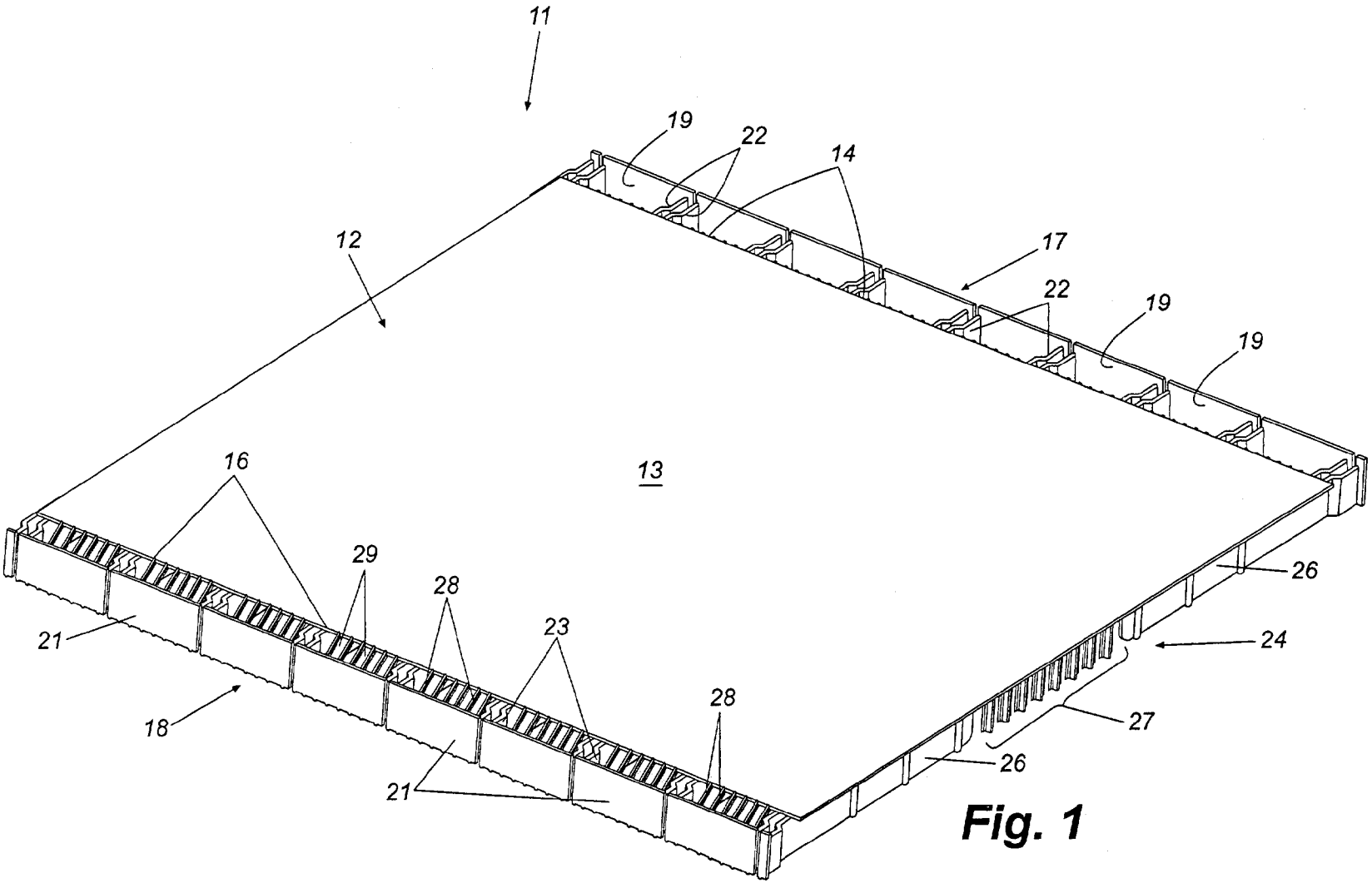
FIG. 1 is a perspective view of a short section of a rollable baffled ridge vent that embodies principles of the present invention in a preferred form.

Referring now in more detail to the drawings, in which like reference numerals refer to like parts throughout the several views, FIG. 1 illustrates a relatively short section of a rollable baffled ridge vent that embodies principles of the present invention in a preferred form. It will be understood that a complete ridge vent is much longer than the short section illustrated in FIG. 1 for unrolling from a rolled-up configuration along the ridge of a roof. A short section is illustrated in the drawings for simplicity and clarity of description. The ridge vent 11, which is made of molded plastic, is formed with a top panel 12 having a laterally flexible central portion 13 and edges 14 and 16. Wind baffles 17 and 18 extend along and outboard of respective edges 14 and 16. Wind baffle 17 is defined by a plurality of aligned coextensive rectangular baffle sections 19 that together form a wind baffle that presents a generally flat face to a lateral wind blowing across the ridge vent 11. Similarly, wind baffle 18 is defined by a plurality of aligned coextensive rectangular baffle sections 21 that also form a baffle presenting a generally flat face to a lateral wind.

Each of the baffle sections 19 is supported and held in position outboard of edge 14 by a pair of buttresses 22 extending laterally outwardly from beneath the top panel 12, as described in more detail below. Each of the baffle sections 21 along the other edge 16 of the top panel likewise is supported and held in position outboard of edge 16 by a pair of buttresses 23 extending laterally from beneath the top panel. The outboard positioning of the baffles 17 and 18 defines a longitudinal space or opening between the panel edges and their respective wind baffles through which attic air can escape from beneath the top panel. An array of spaced apart ribs 28 extend from the edge 16 of the top panel 12 to the bottom edge of each baffle section 21. The ribs 28 span the opening between the edge 16 of the panel and the baffle 21 to prevent insects and other debris from entering through the opening while at the same time allowing for the relatively free flow of attic air out through the opening. Identical arrays of ribs span the opening along the other edge 14 of the panel for the same purpose.

Figure 5:
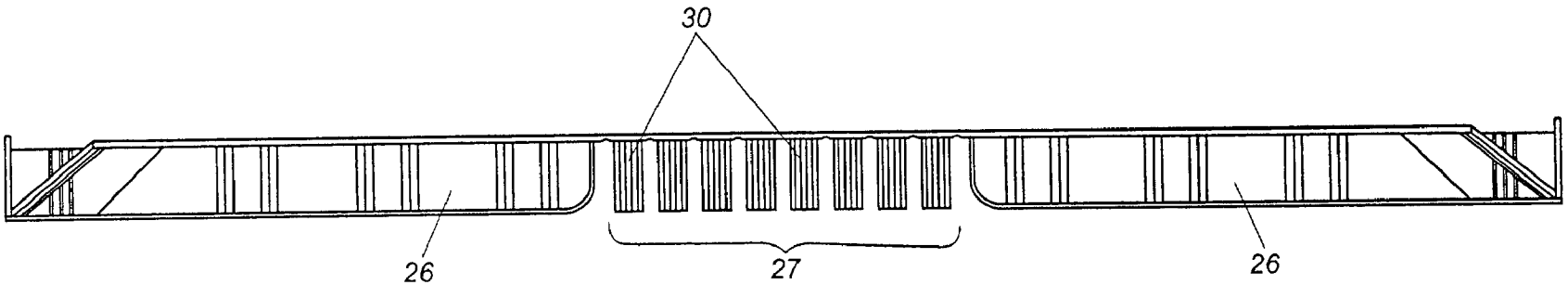
FIG. 5 is a longitudinal cross section of the vent panel section of FIG. 1 in which the integral self-sealing end wall of the vent is visible.

An end wall 24 depends from the top panel 12 on at least one end thereof. This is the free or exposed end of the ridge vent that is located near the end of a roof ridge when the ridge vent is installed. The end wall 24 spans the gap between the top panel 12 and the roof shingles to prevent insects and debris from entering through the exposed end of the ridge vent. The end wall is formed by a pair of solid side sections 26 that depend downwardly to rest on the roof shingles and a fanned central section 27 in the region between the side sections. The central section 27 is formed by an array of side-by-side slightly tapered fingers 30 (FIG. 5). When the ridge vent 11 is flexed laterally along its central portion 13 during installation along a roof ridge, the fingers 30 bunch together to form, along with the side sections 26, a substantially impervious end wall across the width of the vent 11.

It will be recognized by those of skill in the art that the just described ridge vent resembles in many respects a traditional panel-type ridge vent that is installed on a roof in separate end-to-end sections. As a result, the ridge vent of the present invention has been shown to provide the same superior attic ventilation as panel-type ridge vents. However, as a result of the unique construction of the present ridge vent, and particularly the sectioned design of the wind baffles 17 and 18, the vent can be manufactured as long roof-length sections that are rolled up into efficient rolls for storage and transport. During installation, the sections simply are unrolled along the ridge of a roof and attached to the roof decking with nails or other appropriate fasteners. Thus, the ridge vent of this invention offers both the superior ventilation of panel-type ridge vents and the convenience and efficient installation of open weave mat-type rolled ridge vents.

Figure 2:
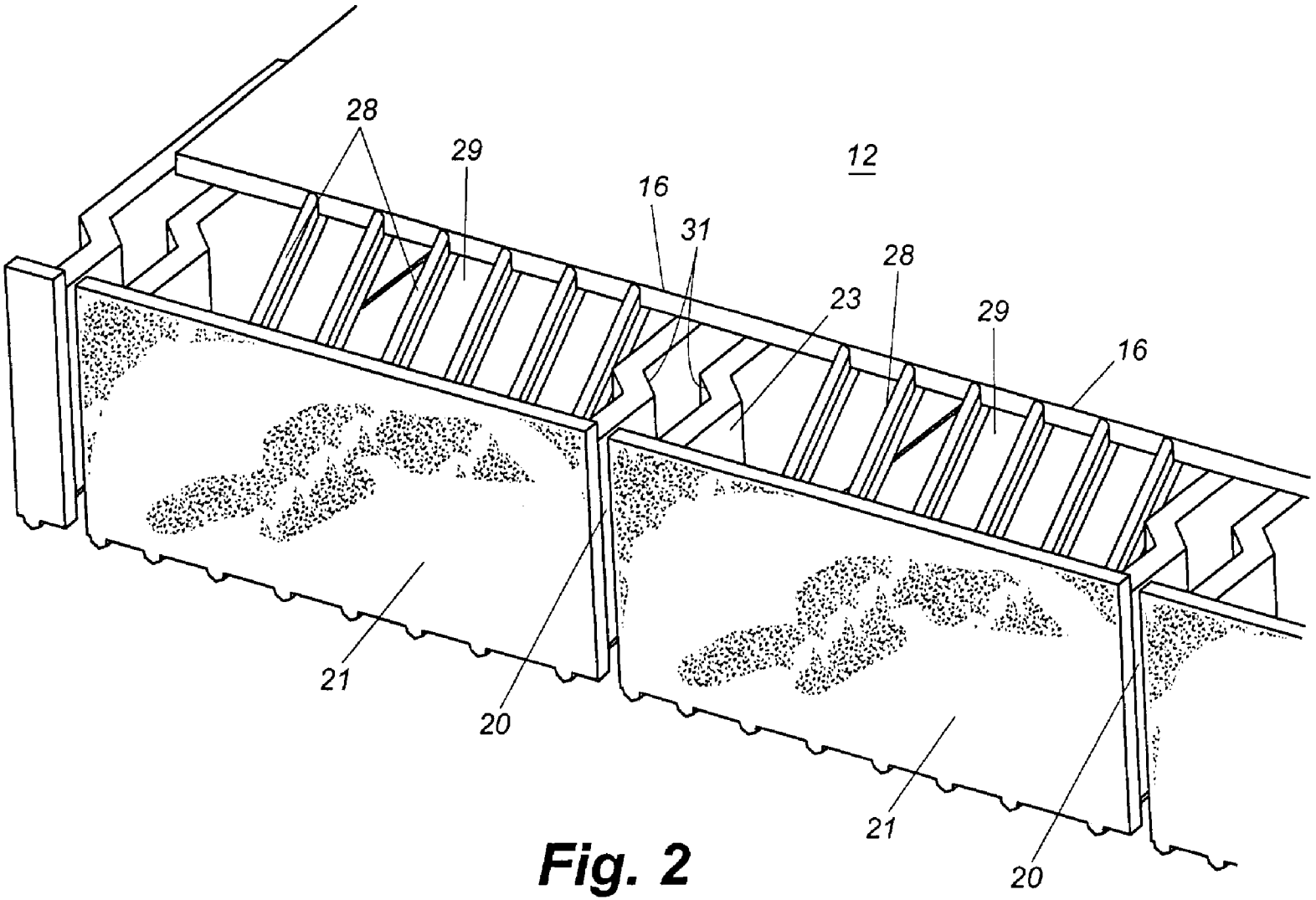
FIG. 2 is an enlarged perspective view of a portion of the vent of FIG. 1 illustrating the baffle sections, their supporting buttresses, and the louvered opening.

FIG. 2 is an enlarged view of a portion of the ridge vent 11 illustrating more clearly the design of the baffle sections 21. Each baffle section 21 has a flat generally rectangular shape and is supported and positioned outboard of the panel edge 16 by a pair of buttresses 23 that extend from beneath the top panel 12 adjacent the ends of the baffle section. The baffle sections 21 are mutually aligned and co-extensive with each other and together define the wind baffle that extends along the length of the vent. Adjacent baffle sections are separated by a narrow gap 20 that opens into the space between buttresses 23 of the sections and ultimately into the space beneath the top panel 12 of the vent. The gaps 20 are sufficiently small to prevent insects and other debris from entering. However, in order to prevent blowing rain from entering through the gaps 20 and leaking into the attic space, the buttresses 23 are formed with matching offsets 31. These offsets form an efficient barrier to windblown rain that might enter the gaps 20 and prevent the rainwater from migrating beneath the top panel 12 and into an attic. A series of small tabs 35 are positioned along the bottom of each baffle section 21. The tabs 35 rest on the shingles of a roof on either side of the ridge and provide a narrow gap beneath the baffle sections through which water entering through the opening between the wind baffle and the top panel can escape. FIG. 2 also provides a better view of the ribs 28 separated by spaces 29 through which attic air escapes from beneath the top panel 12. The ribs 28 preferably are as narrow as possible in their transverse directions and each is formed with a generally aerodynamic shape to present minimum resistance to air flow and to maximize the net free area of the ridge vent 11.

Figure 3:
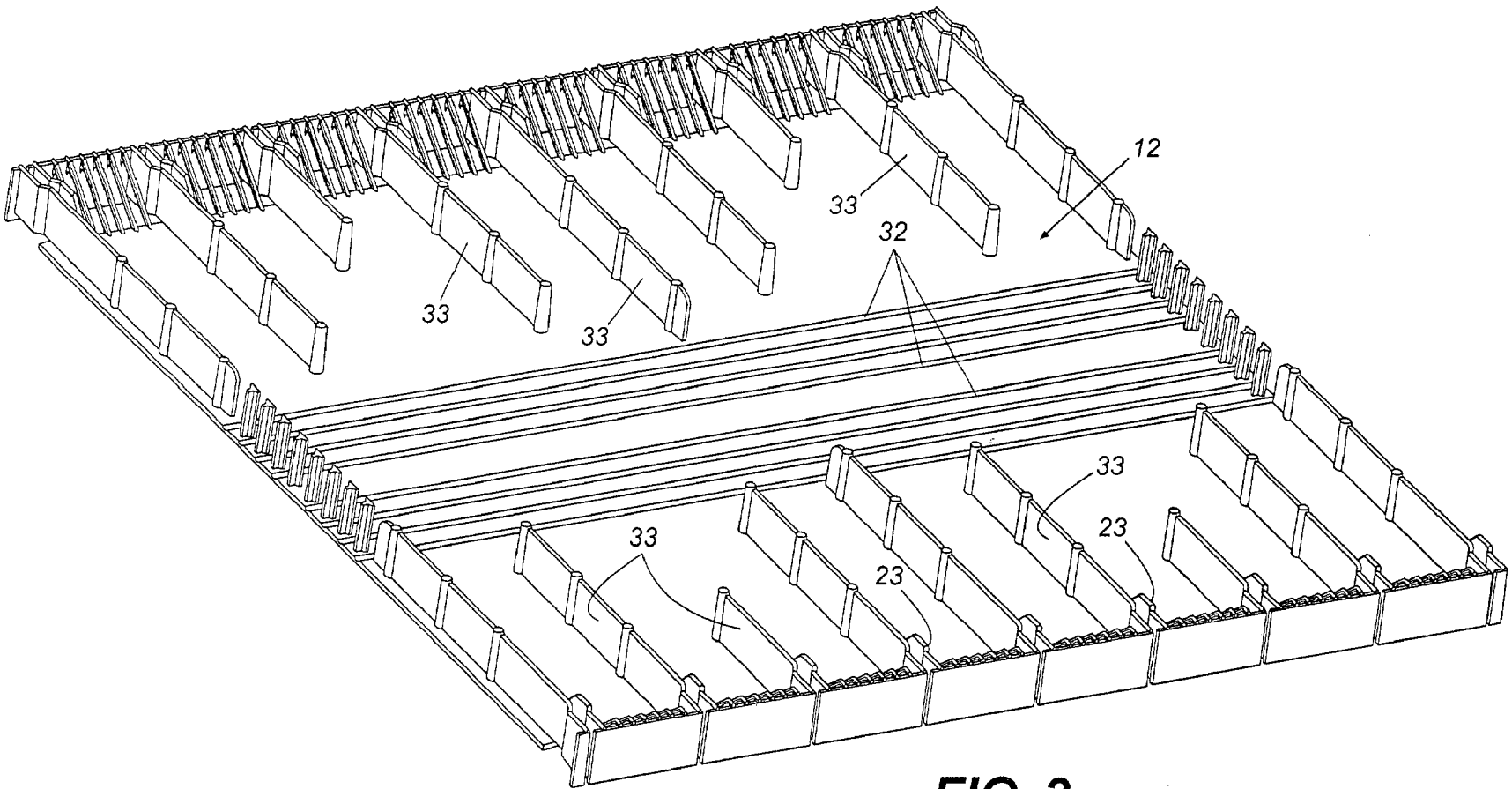
FIG. 3 is a perspective view from the underside of the vent section of FIG. 1 illustrating the inward extension of the buttresses to form lateral support structures beneath the panel.
Figure 4:
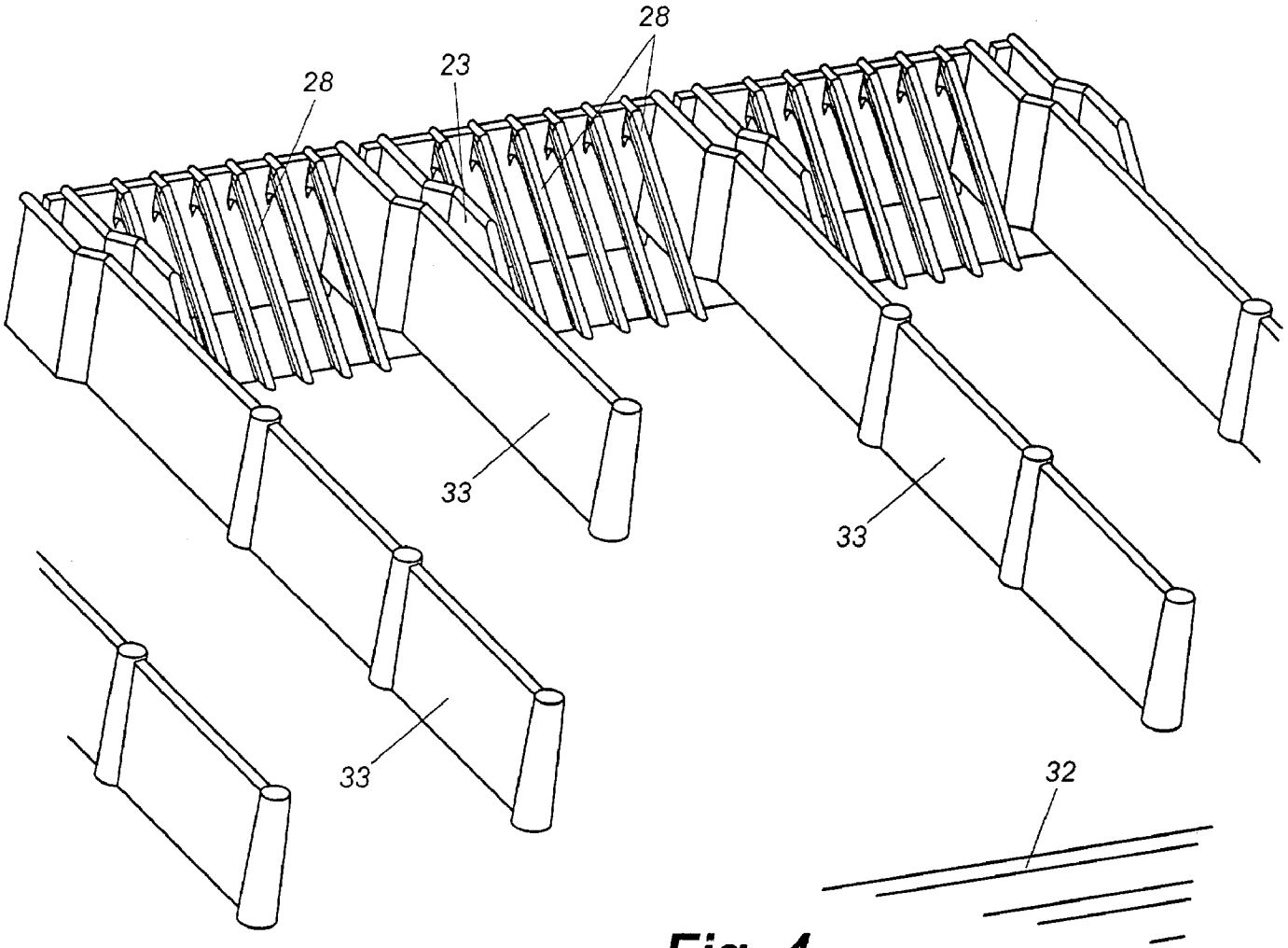
FIG. 4 is an enlarged perspective view of a portion of the underside of the vent shown in FIG. 3 illustrating more clearly the design of the dual function buttress supports.

FIG. 3 is a perspective view of the underside of the ridge vent of the present invention. An array of longitudinally extending scores 32 are formed along the central portion of the panel 12 to enhance the lateral flexibility of the panel in the region where it will be bent over the ridge of a roof. The buttresses that support the outboard baffle sections of the ridge vent extend laterally inwardly toward the central portion of the panel to form a plurality of supports 33. The supports 33 rest on the shingles of a roof on either side of the roof ridge to support the top panel 12 and to maintain the proper spacing between the panel and the roof shingles below. Significantly, and unlike many prior art ridge vents, the supports 33 are relatively thin and extend only laterally relative to the vent. In this way, the supports 33 present the minimum possible obstruction to attic air moving outwardly toward the edges of the vent. As a result, the net free area of the ridge vent is maximized while also providing adequate support for the top panel for receiving nails and shingles. The supports 33 preferably vary in length as shown in FIG. 3 and only every other buttress extends inwardly a significant distance from the respective edge of the panel 12. In this way, the volume of plastic required in the fabrication of the ridge vent is minimized while providing adequate support beneath the panel. FIG. 4 is an enlarged view of a portion of the underside of the ridge vent illustrating in more detail the configuration of the buttresses 23 and supports 33 on the underside of the panel 12.

FIG. 5 is a cross-sectional view of a ridge vent of the present invention looking toward a depending end wall thereof. As previously described, the end wall is formed by a pair of solid depending side sections 26 and a fanned central section 27 defined by a plurality of slightly tapered fingers 30. When the panel of the ridge vent is bent across the ridge of a roof during installation, the fingers 30 bunch together and may even overlap one another to form a substantially impervious end wall at the exposed free ends of a ridge vent installation. As best seen in FIG. 4, the side sections 26 of the end wall, like the supports 33, are inward lateral extensions of buttresses that support baffle sections of the ridge vent.

Figure 6:
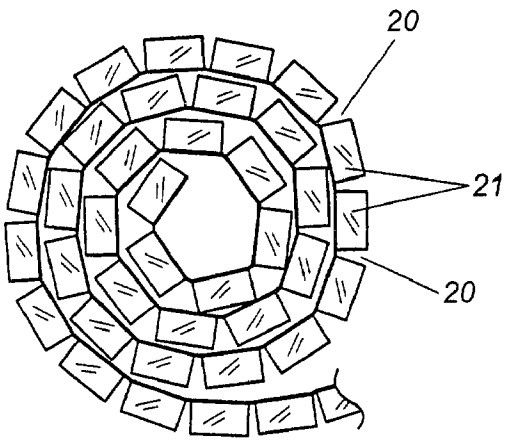
FIG. 6 illustrates a long section of the ridge vent of this invention rolled into a compact roll for shipping and for unrolling onto a roof ridge for installation.

As discussed above, one novel feature of the present invention is its ability to be fabricated in long roof-length sections that are rollable into convenient rolls. FIG. 6 is an end view of such a roll illustrating how the uniquely designed and supported baffle sections of the vent allow for the reliability of the ridge vent. Specifically, when a length of ridge vent is rolled with the top panel facing the center of the roll, the baffle section 21 simply skew or splay with respect to each other with the gaps 20 between adjacent baffle sections spreading into triangular shapes as illustrated. In this way, a singly ridge vent having a length sufficient to extend from one end of a roof ridge to the other can be rolled into a compact roll for shipment to a building site. For installation, the ridge vent is simple unrolled along the roof ridge, positioned, and attached to the roof decking with nails or other appropriate fasteners.

The ridge vent of the present invention may be manufactured using any appropriate fabrication technique, including, possibly, extrusion techniques, roll molding techniques, or otherwise. In the preferred embodiment, however, it has been found most efficient, because of the somewhat complex profile of the vent, to injection mold the vent in relatively short sections of, say, four feet in length. These sections are then attached together during the fabrication process in end-to-end relationship to form a rollable ridge vent of any desired length. The sections may be attached together by any appropriate technique such as, for example, with adhesives, locking tabs formed on the ends of the sections, or, preferably, by sonically welding the sections together at their ends. If roll molding or extrusion techniques are used instead, they may allow for the fabrication of the ridge vent in arbitrarily long unitary sections.

The ridge vent of the present invention, when installed along the open ridge of a roof, provides superior ventilation comparable to prior art panel-type ridge ventilation systems. This is due, in part, to the maximized net free area of the vent as discussed above. In addition, the outboard wind baffles of the present vent are smooth and flat rather than corrugated, undulating, or otherwise discontinuous. As a result, the baffles do not tend to disrupt the substantially laminar flow of wind up and over the wind baffles and across the ridge vent as can be the case with discontinuous baffles. It is believed that maintaining a laminar flow, in contrast to the turbulent flow that can be caused by discontinuous non-flat baffles, results in a more consistent and a stronger low pressure region immediately inboard of the baffles. This, in turn, draws more attic air through the roof ridge resulting in better ventilation performance.

The invention has been described herein in terms of preferred embodiments that are considered by the inventors to be the best mode of carrying out the invention. The specifics of the illustrated embodiments are not, however, intended to be nor should they be considered to be limitations of the invention. Indeed, the spirit and scope of the invention is set forth only in the claims hereof. Many additions, deletions, and modifications might be made to the illustrated embodiments by skilled artisans without departing from that spirit and scope.

What is claimed is:

1. A rollable ridge vent comprising:

an elongated top panel having a flexible central portion, an underside, and edges;

a plurality of buttresses projecting laterally from said edges of said top panel; and a plurality of baffle sections separated by gaps and supported by said buttresses at positions outboard of each of said edges, said baffle sections being aligned and substantially coextensive with each other to define an elongated wind baffle extending along and outboard of each of said edges;

said baffle sections splaying with respect to each other at said gaps when said top panel is bent into an arch to allow said ridge vent to be rolled onto itself in a roll.

2. A rollable ridge vent as claimed in claim 1 and wherein said buttresses project laterally from said underside of said top panel.

3. A rollable ridge vent as claimed in claim 2 and wherein at least some of said buttresses extend inwardly toward said central portion of said top panel on the underside thereof to define supports for spacing and supporting said top panel above a roof.

4. A rollable ridge vent as claimed in claim 1 and wherein said baffle sections are spaced apart by said gaps when said ridge vent is in an unrolled configuration.

5. A rollable ridge vent as claimed in claim 4 and wherein said buttresses are formed with offsets to prevent blowing rain from migrating through said gaps and beneath said top panel.

6. A rollable ridge vent as claimed in claim 1 and further comprising a plurality of spaced apart ribs extending from said edges of said top panel to said baffle sections to prevent insects and debris from entering said ridge vent.

7. A rollable ridge vent as claimed in claim 6 and further comprising an end wall projecting downwardly from said underside of said top panel adjacent a free end thereof for preventing insects and debris from entering said ridge vent through said free end.

8. A rollable ridge vent as claimed in claim 7 and wherein said end wall is formed by a pair of substantially solid side sections on either side of said center portion of said top panel and a fanned section between said side sections at said central portion of said top panel to allow said top panel to be bent across a roof ridge.

9. A rollable ridge vent as claimed in claim 8 and wherein said fanned section is formed by a plurality of spaced apart side-by-side depending fingers that bunch together to form a substantially impervious barrier when said ridge vent is bent across the ridge of a roof.

10. A rollable ridge vent as claimed in claim 1 and wherein said baffle sections are generally planar in shape and, when aligned, form a generally flat planer wind baffle along and outboard of said each of said edges of said top panel.

11. An elongated plastic ridge vent adapted to be rolled into a compact roll for storage and transportation and unrolled along the open ridge of a roof for installation, said ridge vent comprising:

a top panel having a laterally flexible central portion, edges, and an underside;

a plurality of supports depending from said underside of said top panel, said supports extending laterally toward said edges of said top panel;

at least some of said supports extending beyond said edges to form buttresses; and a plurality of baffle sections mounted on said buttresses outboard of said edges, said baffle sections being separated one from the other by gaps and being mutually aligned with each other to define a wind baffle extending along and outboard of each of said edges of said top panel.

12. A ridge vent as claimed in claim 11 and further comprising a plurality of spaced apart ribs extending from said edges of said top panel to said baffle sections.

13. A ridge vent as claimed in claim 12 and wherein said baffle sections are spaced apart a relative small distance at said gaps when said ridge vent is in an unrolled configuration and splay with respect to each other at said gaps when said ridge vent is bent longitudinally into an arch to allow said ridge vent to be rolled into a roll.

14. A ridge vent as claimed in claim 13 and wherein said buttresses are formed with offsets to prevent the migration of blowing rain beneath said ridge vent through the spaces between said baffle sections.

15. An elongated ridge vent for installation along the open ridge of a roof, said ridge vent comprising a top panel having a central portion and edges and an elongated wind baffle extending along and outboard of said edges, said wind baffle being defined by a plurality of baffle sections separated by gaps and aligned in end-to-end relationship with each other to allow said ridge vent to be rolled onto itself into a compact roll.

16. The ridge vent of claim 15 and wherein each baffle section is supported by a pair of buttresses extending laterally from the adjacent edge of said top panel.

17. The ridge vent of claim 16 and wherein at least some of said buttresses extend a predetermined distance toward said central portion of said top panel on an underside thereof to define supports.

18. The ridge vent of claim 17 and wherein the space between said edges and said baffle sections is spanned by a plurality of ribs to prevent debris from entering said ridge vent.

19. The ridge vent of claim 18 and further comprising a depending end wall formed at a free end of said ridge vent to prevent debris from entering said ridge vent through its free end.

20. The ridge vent of claim 19 and wherein a central portion of said depending end wall is defined by a plurality of spaced fingers sized and configured to bunch together when said ridge vent is bent across the roof ridge to form a substantially impervious barrier.

* * * * *